US007005801B2

(12) United States Patent
Uchida

(10) Patent No.: US 7,005,801 B2
(45) Date of Patent: Feb. 28, 2006

(54) PROJECTION TYPE CATHODE RAY TUBE HAVING IMPROVED FOCUS CHARACTERISTICS

(75) Inventor: Go Uchida, Mobara (JP)

(73) Assignee: Hitachi Display, Ltd., Chiba-ken (JP)

( * ) Notice: Subject to any disclaimer, the term of this patent is extended or adjusted under 35 U.S.C. 154(b) by 0 days.

(21) Appl. No.: 10/957,813

(22) Filed: Oct. 4, 2004

(65) Prior Publication Data

US 2005/0077832 A1 Apr. 14, 2005

(30) Foreign Application Priority Data

Oct. 9, 2003 (JP) ..... 2003-350467

(51) Int. Cl.
*H01J 23/02* (2006.01)
*H01J 29/50* (2006.01)

(52) U.S. Cl. ..... 315/5.38; 315/5.37; 313/414

(58) Field of Classification Search ..... 315/5.38, 315/5.37, 382.1
See application file for complete search history.

(56) References Cited

U.S. PATENT DOCUMENTS 6,445,116 B1 * 9/2002 Uchida et al. ..... 313/414
6,492,766 B1 * 12/2002 Tsuzurahara et al. ..... 313/414
6,624,562 B1 * 9/2003 Uchida et al. ..... 313/449
2004/0041511 A1 * 3/2004 Uchida et al. ..... 313/414

OTHER PUBLICATIONS

R. Long et al.; "A 16-cm Dual Neck Diameter, Integrated Component Projection CRT"; The Journal of the Institute of Image Information and Television Engineers; 2003; pp. 983-988 vol. 57 No. 8.

T. Komiya, et al.; Barium-Scandate Dispersed Oxide Cathode for CRT with High Bean Current Density; pp. 631-634; IDW '02; CRT5-2.

* cited by examiner

*Primary Examiner*—Trinh Vo Dinh
(74) *Attorney, Agent, or Firm*—Milbank, Tweed, Hadley & McCloy LLP

(57) ABSTRACT

A projection type cathode ray tube includes a phosphor screen, a cathode, G1, G2 and a main lens composed of first, second and third electrodes. The first and third electrodes are supplied with an anode voltage of the phosphor screen, and the second electrode is supplied with a focus voltage lower than the anode voltage. An inside diameter of an opening in a phosphor screen side end of the second electrode is from 14 mm to 18 mm, and the phosphor screen side end of the second electrode is disposed within the third electrode. An aperture diameter D mm in the G1 electrode and an axial length L mm of the second electrode satisfy the following inequalities: L mm≧60×D mm+27.6 mm, L mm≦−646×D mm+396.3 mm, D mm≧0.44 mm, and L mm≦75 mm.

20 Claims, 9 Drawing Sheets

PROJECTION TYPE CATHODE RAY TUBE HAVING IMPROVED FOCUS CHARACTERISTICS

CLAIM OF PRIORITY

The present application claims priority from Japanese application Serial No. 2003-350467, filed on Oct. 9, 2003, the content of which is hereby incorporated by reference into this application.

BACKGROUND OF THE INVENTION

The present invention relates to a cathode ray tube, and in particular, to a cathode ray tube for use in a projection type image display apparatus such as a projection type TV receiver and a video projector.

The projection type image display apparatus employs three projection type cathode ray tubes for emitting red, green and blue lights, respectively. Three images on the respective panel portions of the three projection type cathode ray tubes are enlarged by a projection lens and are combined on a screen. In a projection type image display apparatus, since images on a panel portion of 127 mm (5 inches) to 178 mm (7 inches) in diagonal dimension of a projection type cathode ray tube are enlarged and projected onto a screen of 1,016 mm (40 inches), for example, in diagonal dimension, the images formed on the panel portion of the projection type cathode ray tube are required to be highly bright and good in focus characteristics. That is to say, it is necessary to limit degradation in focus characteristics to acceptable amounts even when a beam current is increased to produce a highly bright image on the panel portion.

In the present, a horizontal deflection frequency in the projection type image display apparatus is changed from 15 kHz for the conventional NTSC signals to 30 kHz for the Hivision (the Japanese high-definition television format) signals, and the use of signals capable of higher-resolution display has become the most common in the projection type image display apparatus. Consequently, there is a demand for improvement on focus characteristics of projection type cathode ray tubes so that the projection type image display apparatus can produce higher-resolution images. Focus characteristics can be improved by increasing a diameter of a neck portion of a projection type cathode ray tube from 29 mm to 36 mm, and thereby increasing a diameter of a main lens of an electron gun of the projection type cathode ray tube, but, in view of use in place of conventional projection type cathode ray tubes, it is demanded that focus characteristics should be improved by using projection type cathode ray tubes having a 29 mm-diameter neck portion.

SUMMARY OF THE INVENTION

It is an object of the present invention to provide a projection type cathode ray tube having improved focus characteristics without a substantial increase in a diameter of its neck portion.

The following will explain the summary of a representative one of the inventions disclosed in this specification.

In accordance with an embodiment of the present invention there is provided a projection type cathode ray tube comprising: a glass envelope comprising a panel portion, a neck portion, and a funnel portion connecting said panel portion and said neck portion; a phosphor screen formed on an inner surface of said panel portion; and an electron gun housed within said neck portion and emitting an electron beam toward said phosphor screen, wherein said electron gun is provided with an electron beam generating section which comprises a cathode provided with an electron-emissive material, a G1 electrode for controlling said electron beam and a G2 electrode for accelerating said electron beam arranged in the order named, and a main lens which comprises a first cylinder electrode, a second cylinder electrode and a third cylinder electrode arranged in the order named from a cathode side of said main lens and focuses said electron beam from said electron beam generating section on said phosphor screen, wherein said first cylinder electrode and said third cylinder electrode are configured so as to be supplied with a voltage equal to an anode voltage applied to said phosphor screen, and said second cylinder electrode is supplied with a focus voltage lower than said anode voltage, wherein an inside diameter of an opening in an end of said second cylinder electrode on a phosphor screen side thereof is in a range of from 14 mm to 18 mm, and said end of said second cylinder electrode on said phosphor screen side thereof is disposed within said third cylinder electrode, and wherein an aperture diameter D mm in said G1 electrode and an axial length L mm of said second cylinder electrode satisfy the following inequalities: $L\ mm \geqq 60 \times D\ mm + 27.6\ mm$, $L\ mm \leqq -646 \times D\ mm + 396.3\ mm$, $D\ mm \geqq 0.44\ mm$, and $L\ mm \leqq 75\ mm$.

With the above configuration, the present invention provides an advantage of improving focus characteristics of projection type cathode ray tubes without a substantial increase in a diameter of their neck portion.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
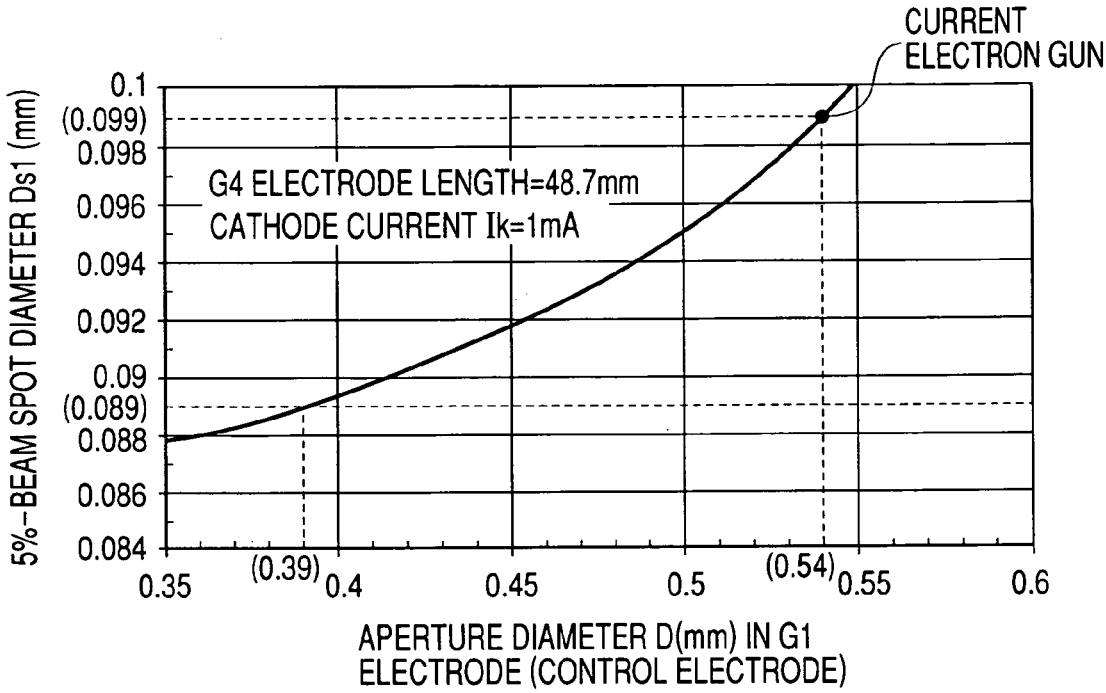
FIG. 1 is a graph showing results obtained by simulation on a relationship between a diameter of an aperture in a G1 electrode and a 5%-beam spot diameter measured at the 5% point of the beam current density profile.

The following will explain representative embodiments in accordance with the present invention in detail by reference to the drawings by comparing those embodiments with a conventional electron gun. The same reference numerals or characters designate functionally similar parts or portions throughout the figures, and repetition of their explanations is omitted.

Figure 9:
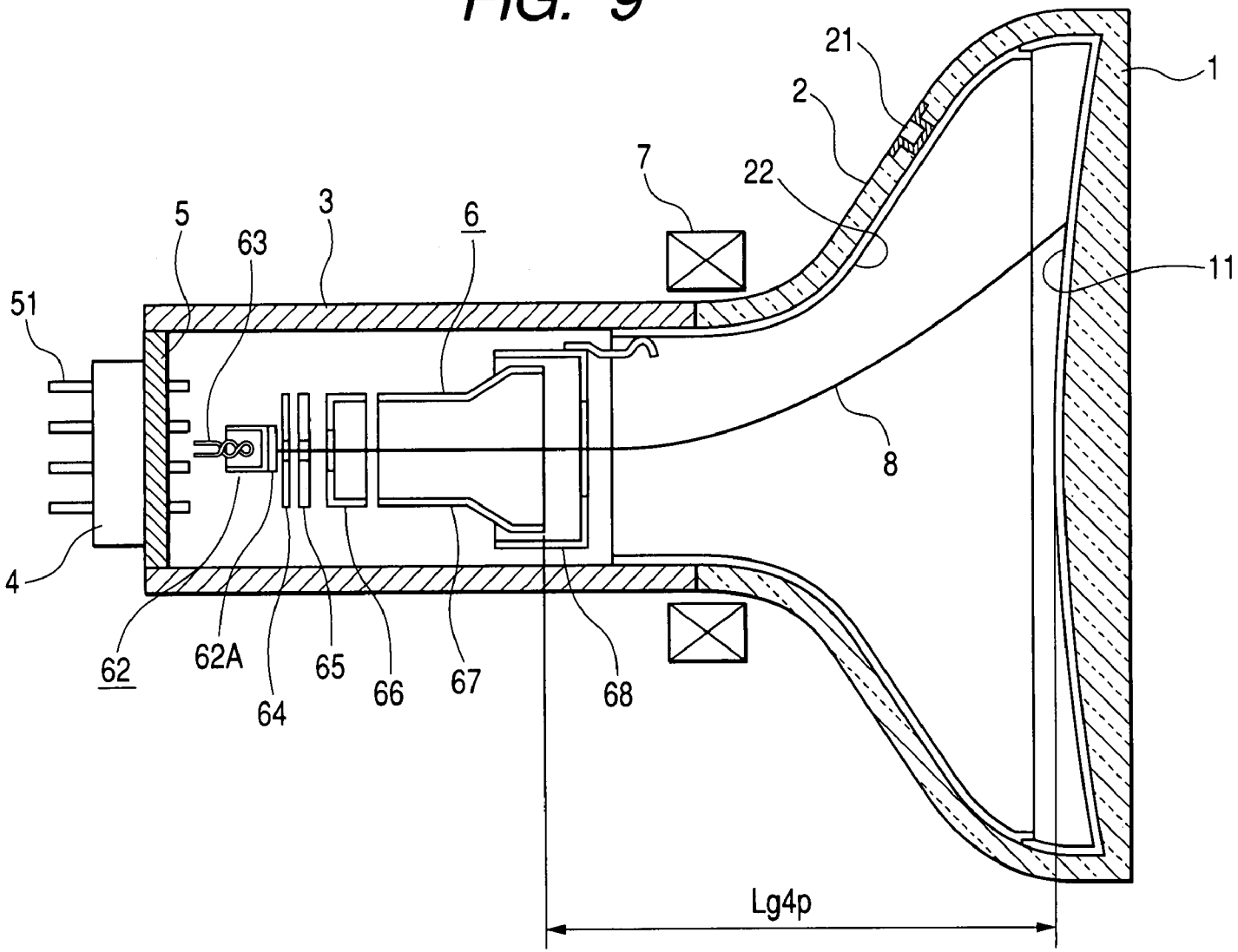
FIG. 9 is a schematic cross-sectional view of a projection type cathode ray tube.

FIG. 9 is a schematic cross-sectional view of a projection type cathode ray tube (hereinafter referred to as a PRT) to which the present invention is directed. The PRT is used for a projection type TV receiver (hereinafter referred to as a PTV) and the like. In FIG. 9, a vacuum envelope is formed by coupling a panel portion 1 and one end of a neck portion 3 with a funnel portion 2 and sealing the other end of the neck portion 3 with a stem 5. An electron gun 6 housed within the neck portion 3 comprises a cathode 62 provided with an electron-emissive material 62A for emitting an electron beam 8, a heater 63 for heating the electron-emissive material 62A, a G1 electrode 64 for controlling the amount of the electron beam 8, a G2 electrode 65 for accelerating the electron beam 8, a G3 electrode 66 for forming a prefocus lens between it and the G2 electrode 65, and a G4 electrode 67 serving as a focus electrode forming a main lens in cooperation with a G5 electrode 68 which serves as an anode electrode. The stem 5 has pins 51 embedded therein for supplying voltages to the respective electrodes of the electron gun 6, and a base 4 is provided for protecting the stem 5 and the pins 51. An anode button 21 is embedded in the funnel portion 2, and an internal graphite film 22 is coated on an inner surface of the funnel portion 2. An anode voltage supplied to the anode button 21 is applied to the G5 electrode 68 of the electron gun 6 via the internal graphite film 22. A generally rectangular phosphor screen 11 for generating one of primary colors is formed on an inner surface of the generally rectangular panel portion 1. A single electron beam 8 is emitted from the electron gun 6, and then the electron beam 8 is deflected in horizontal and vertical directions by a deflection yoke 7 to scan the phosphor screen 11 and thereby to form an image on the phosphor screen 11.

Usually, the outside diameter of the neck portion 3 is selected to be 29 mm, considering deflection sensitivity of the deflection yoke 7, sensitivity of a convergence yoke (not shown) for correcting distortions of rasters projected onto a screen (not shown) and errors in registration among three color rasters projected onto the screen, and use of other standard components. The overall length of a PRT is selected to be in a range of from 240 mm to 290 mm since the PRT is incorporated into an ordinary PTV, and consequently, usually a distance Lg4*p* from an open end of the G4 electrode on its panel portion 1 side to the center of the phosphor screen 11 is selected to be in a range of from 120 mm to 150 mm for the purpose of preventing interference of magnetic fields of the deflection yoke 7. In an example of a conventional electron gun, the distance Lg4*p* is selected to be 140 mm.

Figure 10:
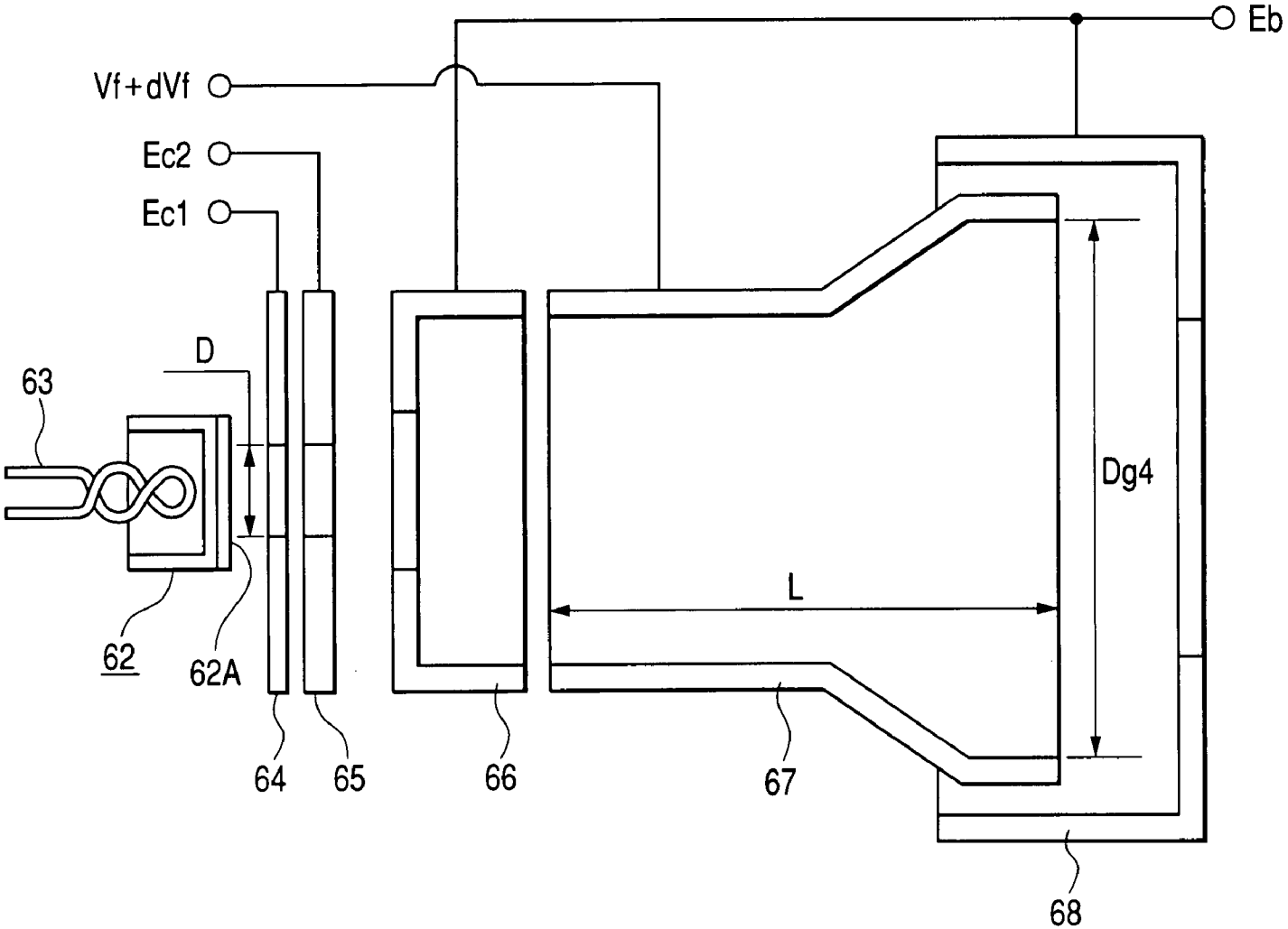
FIG. 10 is a schematic cross-sectional view of an electron gun used in a projection type cathode ray tube.

FIG. 10 is a schematic illustration of the electron gun 6 for the PRT. The cathode 62 emits an electron beam by being heated in a range of from 600° C. to 1200° C. The G1 electrode 64 is supplied with a voltage Ec1 of approximately 0 V for controlling the amount of the electron beam to be emitted from the cathode 62. The G2 electrode 65 is supplied with a voltage Ec2 in a range of from 200 V to 1,000 V for accelerating the electron beam. The G3 electrode 66 is supplied with a voltage of 25,000 V to 35,000 V, equal to a voltage Eb applied to the G5 electrode 68 which serves as an anode, for the purpose of forming a strong prefocus lens between the G2 electrode 65 and the G3 electrode 66. The G4 electrode 67 is supplied with a focus voltage Vf of 5,000 V to 12,000 V to form a main lens which focuses the electron beam on the phosphor screen 11 (see FIG. 9) formed on the inner surface of the panel portion 1, between the G4 electrode 67 and the G5 electrode 68. As described above, the G5 electrode 68 serving as the anode electrode is supplied with the voltage Eb of 25,000 V to 35,000 V, equal to the voltage applied to the G3 electrode 66.

Figure 11:
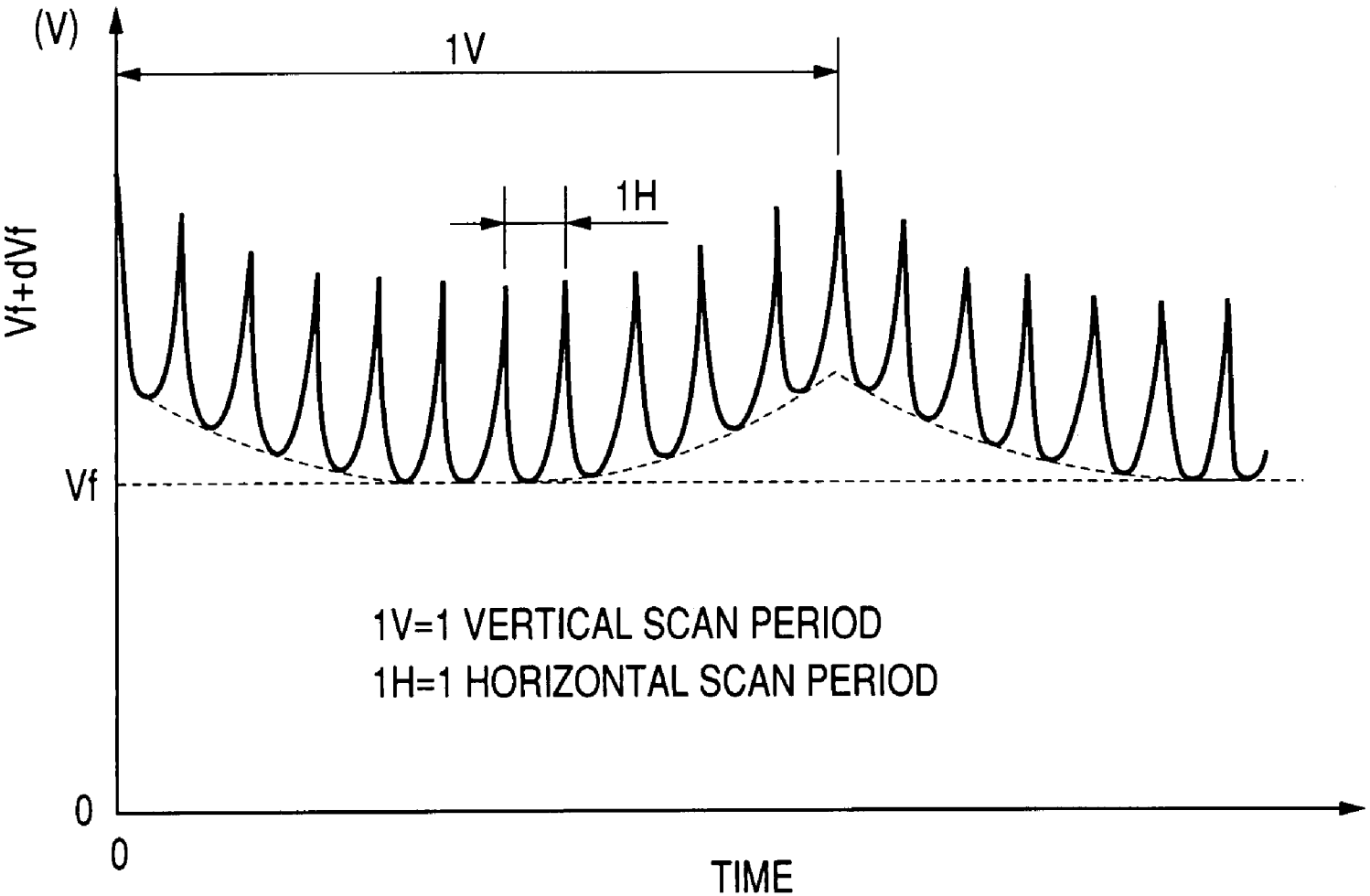
FIG. 11 is a waveform diagram for explaining a dynamic focus voltage dVf applied on a G4 electrode by being superposed on a focus voltage Vf, in synchronism with deflection of an electron beam.

As shown in FIG. 11, it is often that the G4 electrode 67 is supplied with a voltage having a waveform of the focus voltage Vf superposed with a dynamic focus voltage dVf varying in synchronism with scanning deflection of the electron beam, in order to obtain optimum focus of the electron beam over the entire area of the raster.

Conventionally, a diameter of an aperture in the G1 electrode 64 was in a range of from 0.54 mm to 0.60 mm, a diameter of an aperture in the G2 electrode 65 was approximately equal to that of the G1 electrode 64, and in a range of from 0.54 mm to 0.60 mm. A thickness of the G1 electrode 64 was in a range of from 0.05 mm to 0.15 mm, and that of the G2 electrode 65 was in a range of from 0.2 mm to 0.7 mm. A diameter of an aperture in the G3 electrode 66 on its G2 electrode 65 side was in a range of from 1.0 mm to 3.0 mm, and a length of the G3 electrode 66 in a direction of the axis of the PRT was selected to be in a range of from 15 mm to 25 mm, considering breakdown voltage.

In this electron gun, the open end of the G4 electrode 67 on its panel portion 1 side is disposed within the G5 electrode 68 so that the diameter of the main lens is increased, and so that the focus condition does not change even if a potential of the neck portion 3 varies which is produced by charging up of the inner wall of the neck portion 3. The inside diameter of the G5 electrode 68 was selected to be in a range of from 20 mm to 22.5 mm since the wall thickness of the G5 electrode 68 was in a range of from 0.2 mm to 0.5 mm, considering physical tolerance between the inner wall of the neck portion 3 and the G5 electrode 68 in the manufacture of the PRT. The inside diameter of the open end of the G4 electrode 67 on its panel portion 1 side was selected in a range of from 14 mm to 18 mm since the wall thickness of the G4 electrode 67 was in a range of from 0.2 mm to 0.5 mm, to provide a spacing between the G4 electrode 67 and the G5 electrode 68 which ensures a satisfactory withstand voltage therebetween.

An example of the currently-used system employing the PRT of 29 mm in neck portion diameter is described as a comparison example in Table 1 of "A 16-cm Dual Neck Diameter, Integrated Component, Projection CRT," the Journal of the Institute of Image Information and Television Engineers, Vol. 57, No. 8, pp. 983–988 (2003). The present invention will be explained in comparison with this example. For the purpose of improving resolution of the PTV, improvements need to be made on focus characteristics of the current electron gun employed in the above-mentioned currently-used system. In the current electron gun, a diameter of an aperture in the G1 electrode 64 is 0.54 mm, a thickness of the G1 electrode 64 is 0.07 mm, a diameter of an aperture in the G2 electrode 65 is 0.55 mm, and a thickness of the G2 electrode 65 is 0.36 mm. In the G3 electrode 66, a diameter of an aperture in the G3 electrode 66 on its G2 electrode 65 side is 2.0 mm, a length of the G3 electrode 66 in a direction of the PRT tube axis is 20 mm. In the G4 electrode 67, a diameter Dg4 of an aperture in the G4 electrode 67 on its panel portion 1 side is 16 mm, a length of the G4 electrode 67 in the direction of the PRT tube axis is 48.7 mm. An inside diameter of the G5 electrode 68 is 22 mm. A distance Lg4*p* (see FIG. 9) between the open end of the G4 electrode 67 on its panel portion 1 side and the center of the phosphor screen 11 is 140 mm.

The average cathode current of 1 mA flows in the PRT incorporated in the PTV. Therefore, for the purpose of improving focus characteristics, it is necessary to reduce the beam spot diameter at a cathode current Ik=1 mA. Further, it is difficult to perceive improvement in resolution on the PTV screen if the beam spot diameter is not reduced by 10% or more. Therefore, to achieve the improvement on resolution on the PTV screen, it is necessary to reduce the beam spot diameter Ds1 at the cathode current Ik=1 mA by 10% or more compared with that obtained by the current electron gun.

The beam spot diameter is reduced by using a method of reducing the diameter of an aperture in the G1 electrode as described in Japanese Patent Application Laid-Open No. 2000-250491 Publication. Therefore, the beam spot diameters Ds1 obtained by the diameter of the aperture in the G1 electrode of the current electron gun and the further reduced diameters of the aperture in the G1 electrode are calculated by simulation. In this simulation, the electrode structures other than the aperture diameter in the G1 electrode are the same as those in the above-mentioned specifications of the current electron gun.

First, calculated was a 5%-beam spot diameter Ds1 (a beam spot diameter measured at the 5% point of the beam current density profile, and hereinafter referred to merely as a beam spot diameter also) for a cathode current Ik=1 mA, and the results are shown in FIG. 1. When the aperture diameter D in the G1 electrode 64 is 0.54 mm as in the case of the current PRT, the 5%-beam spot diameter Ds1 turned out to be 0.099 mm. This shows that the beam spot diameter for realizing improvement in focus characteristics is equal to or smaller than 0.089 mm which reduces the current beam spot diameter Ds1 by 10% or more. FIG. 1 shows that the aperture diameter D in the G1 electrode 64 needs to be selected to be equal to or smaller than 0.39 mm, to make the beam spot diameter Ds1 equal to or smaller than 0.089 mm.

However, a problem arises in that the reduction in the aperture diameter D in the G1 electrode 64 increases load on a cathode and degrades lifetime characteristics. It is thought that lifetime of the PRT needs to be 20,000 hours or more, as described in "Barium-Scandate Dispersed Oxide Cathode for CRT with High Beam Current Density," IDW '02 CRT5-2, pp. 631–634.

Figure 2:
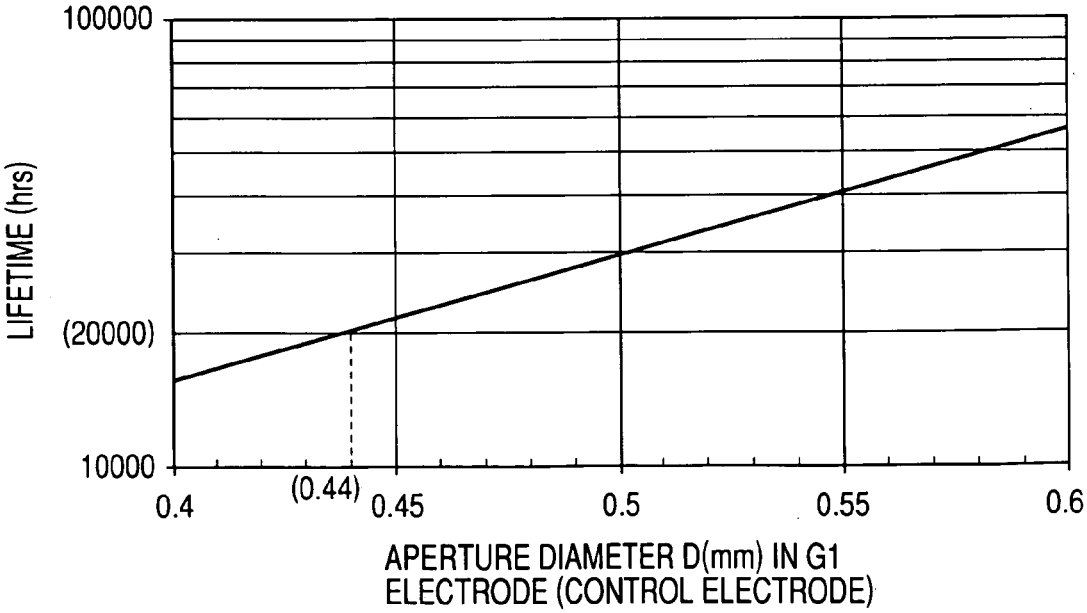
FIG. 2 is a graph showing a relationship between a diameter of an aperture in a G1 electrode and lifetime in cases where an oxide cathode containing barium scandate is employed.
Figure 3:
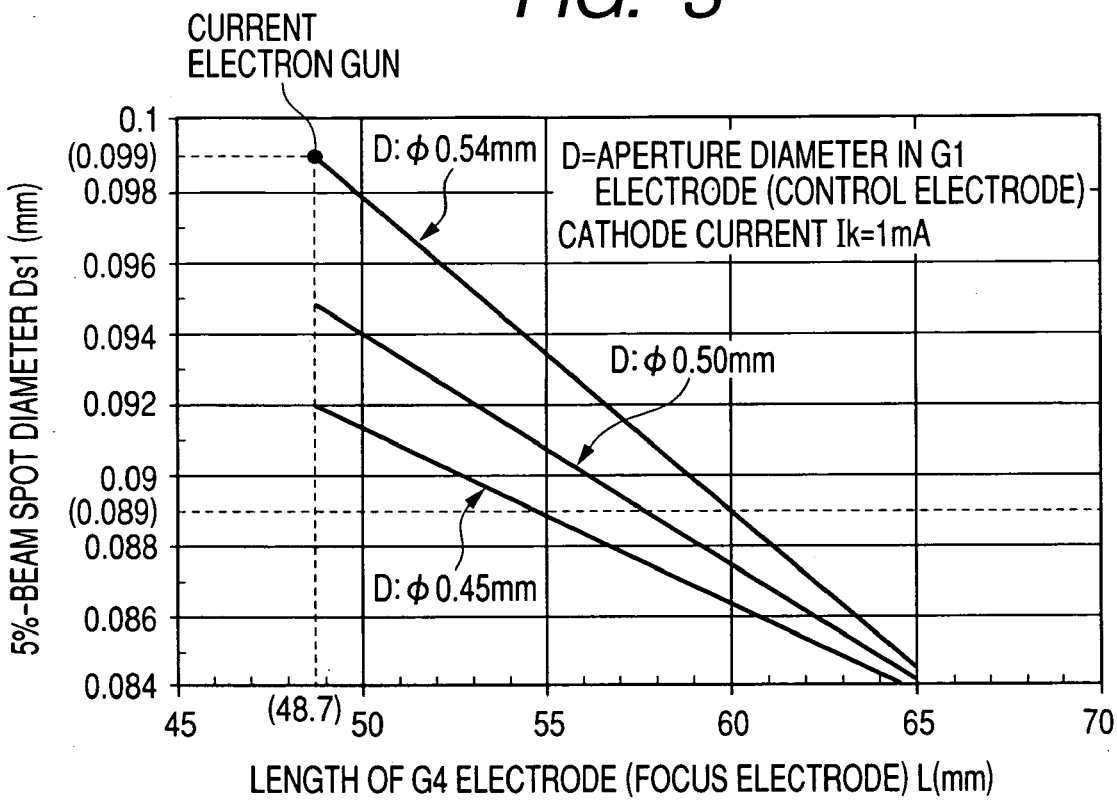
FIG. 3 is a graph showing results obtained by simulation on a relationship between an axial length of a G4 electrode and a beam spot diameter with a diameter of an aperture in a G1 electrode as a parameter, in the case of a cathode current of 1.0 mA.

FIG. 2 shows a relationship between lifetime and the aperture diameter D in the G1 electrode 64 in a case where an oxide cathode is employed which contains barium scandate and is the most common at present. FIG. 2 shows that the aperture diameter D in the G1 electrode 64 needs to be equal to or larger than 0.44 mm for obtaining lifetime of 20,000 hours or more. On the other hand, the aperture diameter D in the G1 electrode 64 needs to be 0.39 mm or smaller for improving focus characteristics, and this dimension of the aperture diameter D in the G1 electrode 64 causes a great problem with lifetime characteristics. Consequently, the improvement in focus characteristics can not be achieved by reducing of the aperture diameter D in the G1 electrode 64 only. Therefore, improvement in focus characteristics were studied by varying the axial length L of the G4 electrode 67. FIG. 3 shows results of simulation on a relationship between the axial length L of the G4 electrode 67 and the beam spot diameter Ds1 with the aperture diameter D in the G1 electrode 64 as a parameter. In this simulation, the electrode structures other than the aperture diameter D in the G1 electrode and the axial length L of the G4 electrode 67 are the same as those in the above-mentioned specifications of the current electron gun.

FIG. 3 shows that the beam spot diameter Ds1 is made smaller by lengthening the axial length L of the G4 electrode 67. When the axial length L of the G4 electrode 67 is increased, the object point is made further from the main lens, and therefore the incidence angle of electrons entering the main lens is made smaller. Since aberration characteristics of a lens deteriorate in proportion to the third power of the angle of incidence, by increasing the axial length L of the G4 electrode 67 and thereby decreasing the angle of incidence of electron beams entering the main lens the aberration characteristics of the lens are improved and thereby the beam spot diameter on the phosphor screen is reduced.

Figure 4:
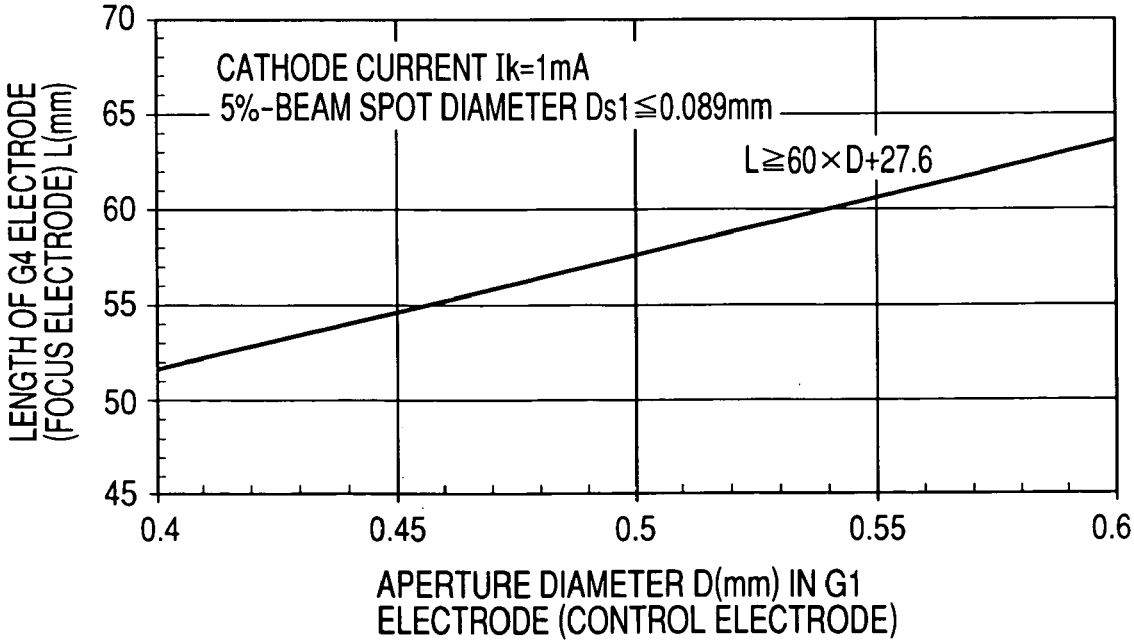
FIG. 4 is a graph showing results obtained from FIG. 3 on a relationship between an axial length of a G4 electrode of a cathode ray tube and a diameter of an aperture in a G1 electrode for a beam spot diameter to be 0.089 mm or smaller at a cathode current of 1.0 mA.

FIG. 4 shows a relationship obtained from FIG. 3, between the aperture diameter D in the G1 electrode and the axial length L of the G4 electrode, required to make the beam spot diameter Ds1 equal to or smaller than 0.089 mm at a cathode current Ik=1.0 mA, the value of the beam spot diameter Ds1 being necessary for improvement in resolution on the screen of the PTV. FIG. 4 shows that, if the aperture diameter D in the G1 electrode 64 and the axial length L of the G4 electrode 67 satisfy the following inequality:

$$L\ \text{mm} \geqq 60 \times D\ \text{mm} + 27.6\ \text{mm} \quad (1),$$

the beam spot diameter Ds1 at a cathode current Ik=1.0 mA can be made equal to or smaller than 0.089 mm.

However, it was found that the following problem arises. When the PTV produces a peak-brightness image, a cathode current Ik=4 mA flows in the PRT. If focus characteristics is degraded at the cathode current Ik=4 mA, resolution of images viewed on the PTV is deteriorated even when focus characteristics at the cathode current Ik=1 mA have been improved. In view of this, the 5%-beam spot diameter Ds4 at the cathode current Ik=4 mA was calculated by simulation on the current electron gun using the above-described specifications for the current electron gun. The beam spot diameter Ds4 for the current electron gun turned out to be 0.256 mm. This indicates that the beam spot diameter Ds4 at the cathode current Ik=4 mA needs to be made equal to or smaller than 0.256 mm.

Figure 5:
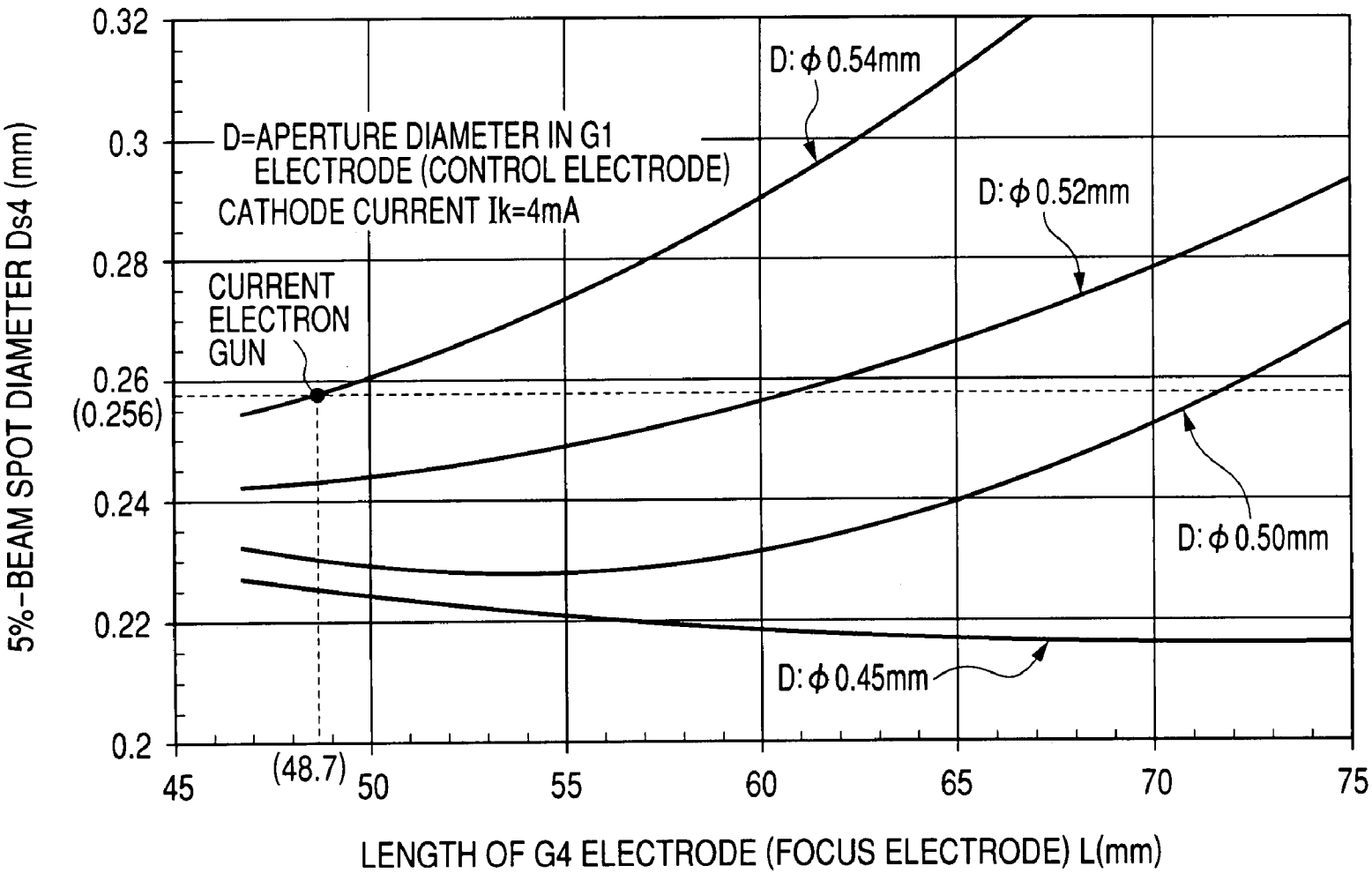
FIG. 5 is a graph showing results obtained by simulation on a relationship between an axial length of a G4 electrode and a beam spot diameter with a diameter of an aperture in a G1 electrode as a parameter, in the case of a cathode current of 4 mA.

FIG. 5 shows results of simulation on a relationship between the beam spot diameter Ds4 and the axial length L of the G4 electrode 67 with the aperture diameter D in the G1 electrode 64 as a parameter. FIG. 5 indicates that, if the axial length L of the G4 electrode 67 is made longer than 48.7 mm which is the corresponding dimension of the current gun in a case where the aperture diameter D in the G1 electrode 64 is 0.54 mm as in the case of the current electron gun, the beam spot diameter Ds4 turned out to be increased. Further, in a case where the aperture diameter D in the G1 electrode 64 is 0.50 mm, when the axial length L of the G4 electrode 67 is made longer than 48.7 mm which is the corresponding dimension in the current electron gun, the beam spot diameter Ds4 is somewhat reduced, but begins to increase where the axial length L of the G4 electrode 67 is approximately 60 mm. This can be explained as follows. When the axial length L of the G4 electrode 67 is increased, aberration characteristics of the main lens are improved as explained above, but at the cathode current Ik=4 mA, an optimum diameter of the electron beam entering the main lens cannot be secured, thereby increasing the amount of deviation of the diameter of the electron beam incident into the main lens from its optimum diameter, and consequently, at some value of the axial length L of the G4 electrode 67, the deviation of the electron beam diameter from its optimum diameter exerts greater influences than the improvement on the aberration of the main lens, and thereby the beam spot diameter Ds4 is increased. As is apparent from FIG. 5, this relationship between the axial length L of the G4 electrode 67 and the beam spot diameter Ds4 varies with the aperture diameter D in the G1 electrode 64.

Figure 6:
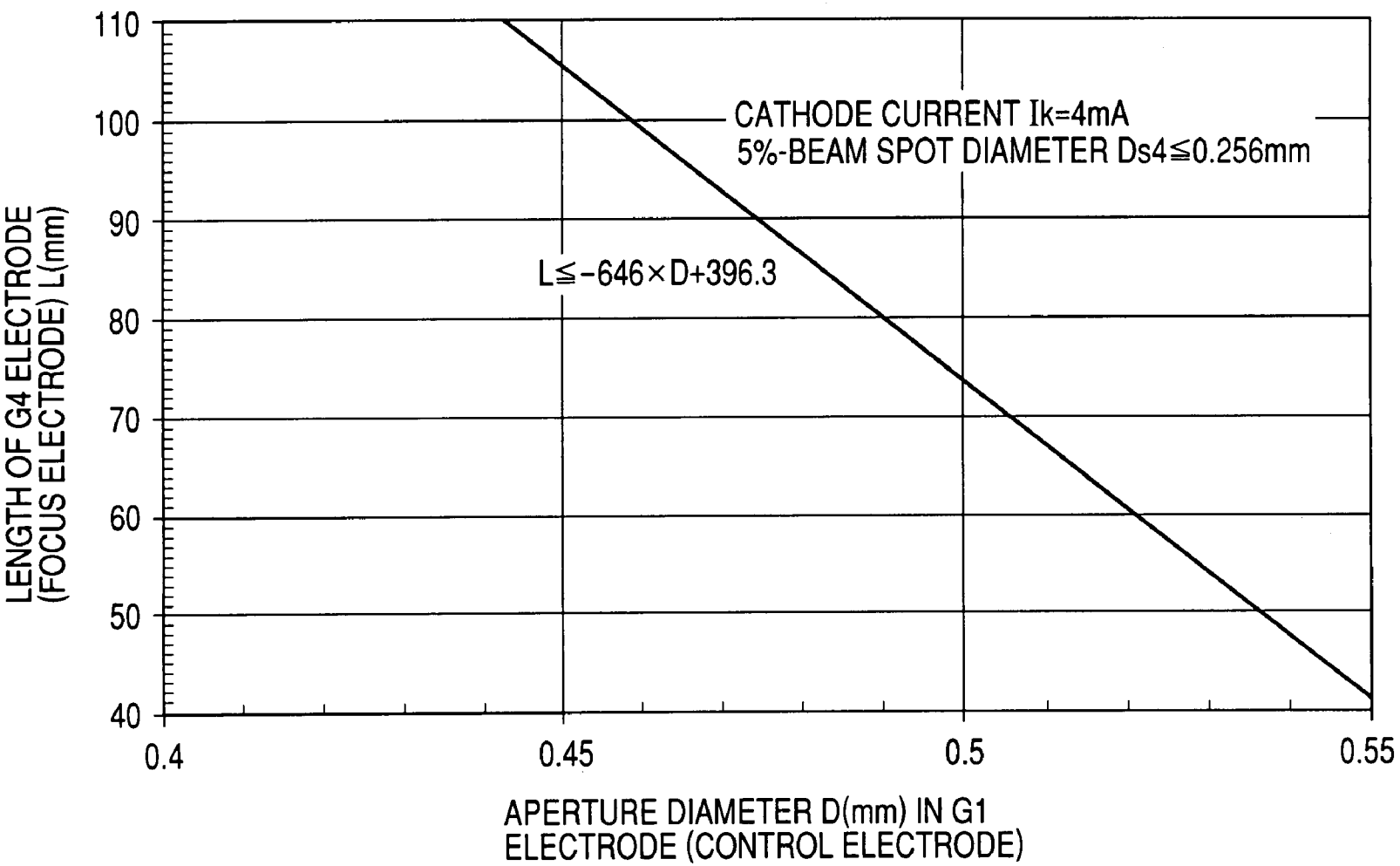
FIG. 6 is a graph showing results obtained from FIG. 5 on a relationship between an axial length of a G4 electrode of a cathode ray tube and a diameter of an aperture in a G1 electrode, for a beam spot diameter to be 0.256 mm or smaller at a cathode current of 4.0 mA.

FIG. 6 shows a relationship between the aperture diameter D in the G1 electrode 64 and the axial length L of the G4 electrode 67, obtained from FIG. 5, required to make the beam spot diameter Ds4 at the cathode current Ik=4 mA equal to or smaller than 0.256 mm which is the beam spot diameter Ds4 obtainable by the current electron gun. FIG. 6 indicates that if the aperture diameter D in the G1 electrode 64 and the axial length L of the G4 electrode 67 satisfy the following relationship:

$$L\ \text{mm} \leqq -646 \times D\ \text{mm} + 396.3\ \text{mm} \quad (2),$$

the beam spot diameter Ds4 at the cathode current Ik=4 mA can be made equal to or smaller than 0.256 mm which is the beam spot diameter obtainable by the current electron gun.

Figure 7:
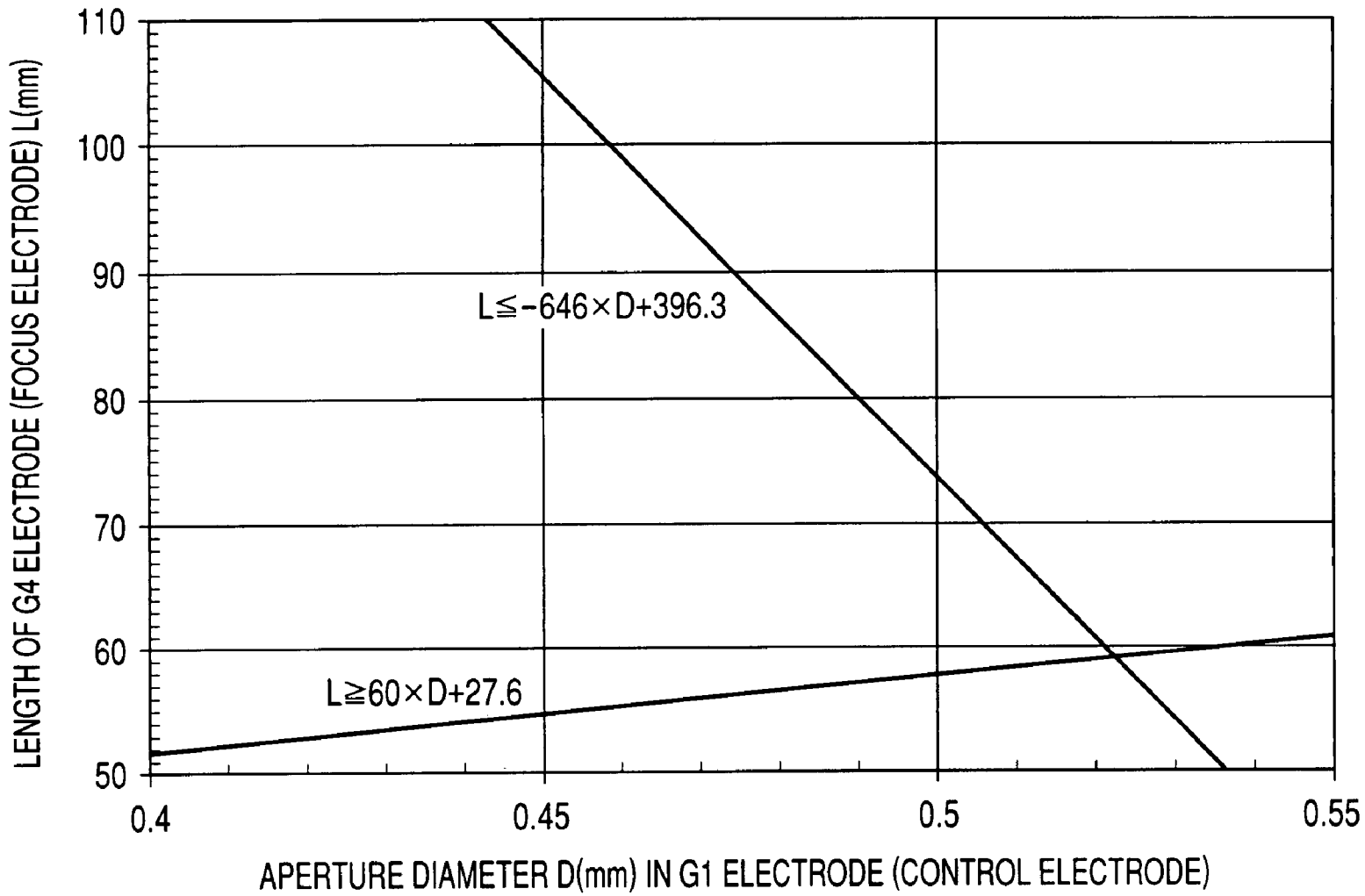
FIG. 7 is a graph showing a relationship between a diameter of an aperture in a G1 electrode and an axial length of a G4 electrode and a beam spot diameter for providing a perceptible improvement in resolution at cathode currents of both 1 mA and 4 mA.

For the purpose of improving resolution of the PTV, it is necessary that both the inequalities (1) and (2) are satisfied at the same time. FIG. 7 shows the relationships between the aperture diameter D in the G1 electrode 64 and the axial length L of the G4 electrode 67 represented by the inequalities (1) and (2). FIG. 7 indicates that if the aperture diameter D in the G1 electrode 64 and the axial length L of the G4 electrode 67 lie in an area defined by the following inequalities:

$$L\ \text{mm} \leqq 60 \times D\ \text{mm} + 27.6\ \text{mm} \quad (1), \text{ and}$$

$$L\ \text{mm} \leqq -646 \times D\ \text{mm} + 396.3\ \text{mm} \quad (2),$$

resolution of the PTV can be improved.

By way of example, a 29 mm-diameter neck PRT will be explained which employs a Hi-UPF type electron gun (which incorporates a unipotential electron lens in which a focus electrode is supplied with a high voltage). In this PRT, the aperture diameter D in the G1 electrode 64 is selected to be 0.5 mm, and the axial length L of the G4 electrode 67 is selected to be 59 mm. In this case, an aperture diameter in the G2 electrode 65 is 0.5 mm, an axial length of the G3 electrode 66 is 20 mm, and a diameter Dg4 of an opening in an end of the G4 electrode 67 on its panel portion 1 side is 16 mm. In this example, the beam spot diameter Ds1 at the cathode current Ik=1 mA is 0.088 mm, the beam spot diameter Ds4 at the cathode current Ik=4 mA is 0.232 mm, these values satisfy the criteria on which to judge whether the improvement in focus characteristics has been achieved, that is, the beam spot diameter Ds1 at the cathode current Ik=1 mA being 0.089 mm or smaller, the beam spot diameter Ds4 at the cathode current Ik=4 mA being 0.256 mm or smaller, and therefore the improvement in resolution of the PTV has been achieved.

The following will explain the cathode 62. As shown in FIG. 10, the cathode 62 has the electron-emissive material 62A on its top surface. The electron-emissive material 62A can be composed chiefly of an oxide of alkaline earth metals including at least Ba, for example, an oxide composed of barium, strontium and calcium, (Ba.Sr.Ca)O, and can also contain a composite oxide of barium and scandium, for example, barium scandate $Ba_2Sc_2O_5$. Here, the amount of scandium can be selected to be in a range of from 0.01 wt % to 5.0 wt %.

As an example of an electron gun using the above-described electron-emissive material 62A, by selecting the aperture diameter D in the G1 electrode 64 to be 0.44 mm or larger and selecting the aperture diameter D in the G1 electrode 64 and the axial length L of the G4 electrode 67 so as to satisfy the above-described inequalities (1) and (2), lifetime of 20,000 hours or more is secured, and the improvement in resolution of the PTV can be achieved.

Further, as a more specific example of an electron gun using the above-described electron-emissive material 62A, the following will explain an electron gun of the Hi-UPF type used in a 29-mm diameter neck PRT in which the aperture diameter D in the G1 electrode 64 is selected to be 0.5 mm, the axial length L of the G4 electrode 67 is selected to be 59 mm, and the dimensions of the remainder of the electrodes are selected to be the same as those in the above-described current electron gun. The beam spot diameter Ds1 at the cathode current Ik=1 mA is 0.088 mm, the beam spot diameter Ds4 at the cathode current Ik=4 mA is 0.232 mm, and lifetime of 30,000 hours can be secured. These results achieves the above-described target of improvement in focus characteristics, in which the beam spot diameter Ds1 at the cathode current Ik=1 mA is 0.089 mm or smaller, the beam spot diameter Ds4 at the cathode current Ik=4 mA is 0.256 mm or smaller, and lifetime is 20,000 hours or longer, and this indicates that the improvement in resolution of the PTV can be accomplished.

Figure 8:
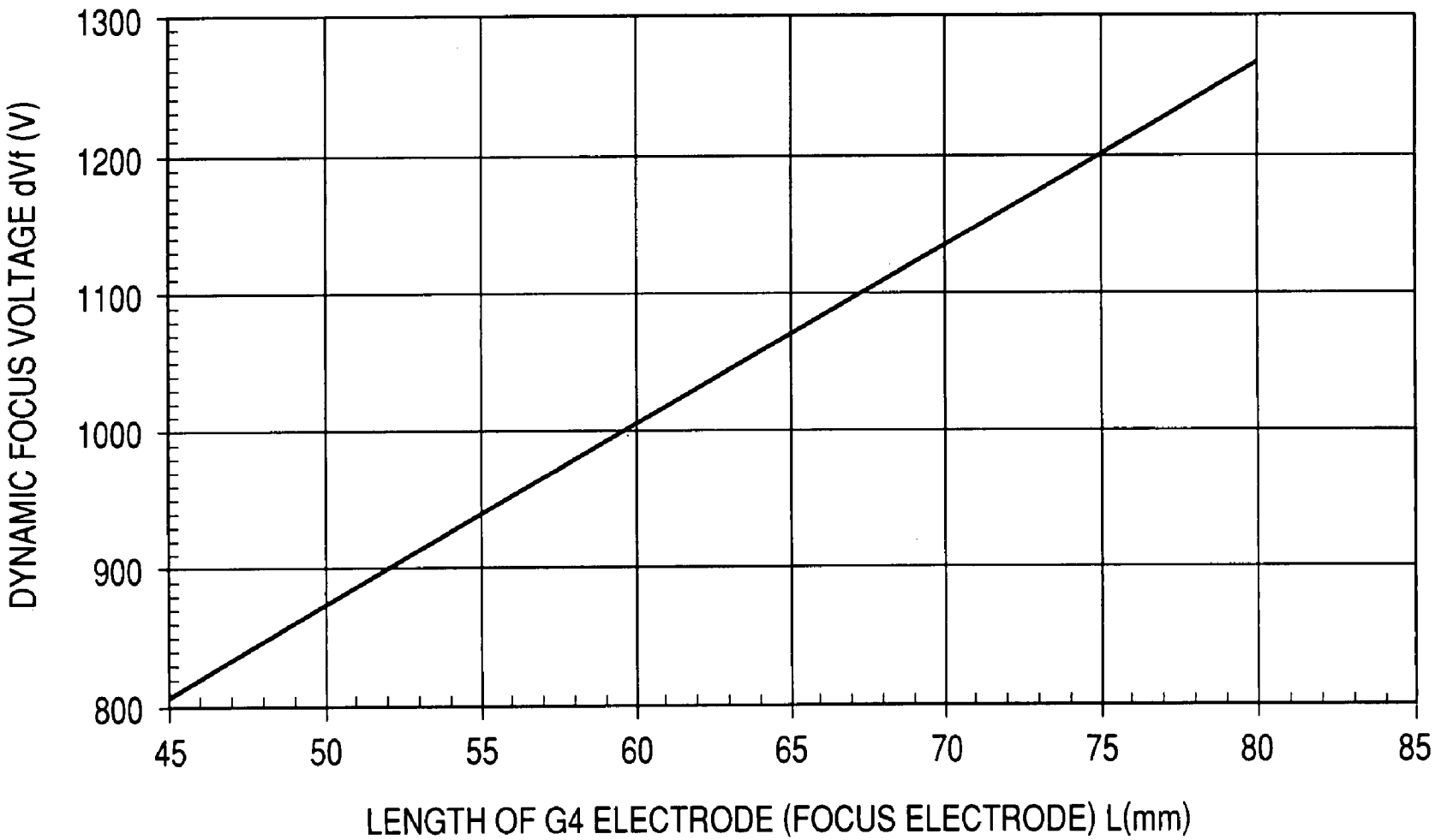
FIG. 8 is a graph showing a relationship between an axial length of a G4 electrode and a dynamic focus voltage.

Further, the axial length L of the G4 electrode 67 is also related to the dynamic focus voltage dVf explained in connection with FIG. 11. The dynamic focus voltage dVf increases as the axial length L of the G4 electrode 67 is increased, and FIG. 8 shows this relationship between the axial length L of the G4 electrode 67 and the dynamic focus voltage dVf. If the dynamic focus voltage dVf becomes 1,200 V or higher, fabrication of a circuit for generating the dynamic focus voltage dVf becomes difficult due to withstanding voltage characteristics of ICs (Integrated Circuits) forming the circuit. Therefore it is desirable to limit the dynamic focus voltage dVf to 1,200 V. FIG. 8 shows that it is necessary to select the axial length L of the G4 electrode 67 to be 75 mm or shorter so as to limit the dynamic focus voltage dVf to 1,200 V. Therefore, when the above-described inequalities (1) and (2) are satisfied and the axial length L of the G4 electrode 67 is equal to or shorter than 75 mm, the resolution of the PTV can be improved without causing problems in fabrication of a circuit for generating the dynamic focus voltage dVf.

Here, in an electron gun of the Hi-UPF type used in a 29-mm diameter neck PRT in which the aperture diameter D in the G1 electrode 64 is selected to be 0.5 mm, the axial length L of the G4 electrode 67 is selected to be 59 mm, and the dimensions of the remainder of the electrodes are selected to be the same as those in the above-described current electron gun, the dynamic focus voltage dVf is 990 V, the beam spot diameter Ds1 at the cathode current Ik=1 mA is 0.088 mm, the beam spot diameter Ds4 at the cathode current Ik=4 mA is 0.232 mm. Therefore, the dynamic focus voltage dVf is not higher than 1,200 V, and the above results satisfy the conditions for providing a perceptible improvement in focus characteristics that the beam spot diameter Ds1 at the cathode current Ik=1 mA is equal to or smaller than 0.089 mm, the beam spot diameter Ds4 at the cathode current Ik=4 mA is equal to or smaller than 0.256 mm. Consequently, the improvement in resolution of the PTV can be achieved without causing problems with fabrication of a circuit for generating the dynamic focus voltage dVf.

The above explanation has been made only about representative examples of the electrode configurations for the electron gun, but the same advantages as in the case of the above-described representative examples of the electrode configurations can also be obtained in a case where the inside diameter Dg4 of the opening in the end of the G4 electrode 67 on its phosphor screen 11 side is in a range of from 14 mm to 18 mm, the axial length of the G3 electrode 66 is in a range of from 15 mm to 25 mm, the inside diameter of the G5 electrode 68 is in a range of from 20 mm to 22.5 mm, the distance between the end of the G4 electrode 67 on its phosphor screen 11 side and the center of the phosphor screen 11 is in a range of from 120 mm to 150 mm, and the thickness of the G1 electrode 64 is in a range of from 0.05 mm to 0.15 mm.

By adopting the above-described dimensions of the electrodes for an electron gun, the overall length of the projection type cathode ray tube can be limited to a range of from 240 mm to 290 mm.

What is claimed is:

1. A projection type cathode ray tube comprising:

a glass envelope comprising a panel portion, a neck portion, and a funnel portion connecting said panel portion and said neck portion;

a phosphor screen formed on an inner surface of said panel portion; and an electron gun housed within said neck portion and emitting an electron beam toward said phosphor screen, wherein said electron gun is provided with an electron beam generating section which comprises a cathode provided with an electron-emissive material, a G1 electrode for controlling said electron beam and a G2 electrode for accelerating said electron beam arranged in the order named, and a main lens which comprises a first cylinder electrode, a second cylinder electrode and a third cylinder electrode arranged in the order named from a cathode side of said main lens and focuses said electron beam from said electron beam generating section on said phosphor screen, wherein said first cylinder electrode and said third cylinder electrode are configured so as to be supplied with a voltage equal to an anode voltage applied to said phosphor screen, and said second cylinder electrode is supplied with a focus voltage lower than said anode voltage, wherein an inside diameter of an opening in an end of said second cylinder electrode on a phosphor screen side thereof is in a range of from 14 mm to 18 mm, and said end of said second cylinder electrode on said phosphor screen side thereof is disposed within said third cylinder electrode, and wherein an aperture diameter D mm in said G1 electrode and an axial length L mm of said second cylinder electrode satisfy the following inequalities:

$$L\ \text{mm} \geqq 60 \times D\ \text{mm} + 27.6\ \text{mm},$$

$$L\ \text{mm} \leqq -646 \times D\ \text{mm} + 396.3\ \text{mm},$$

$$D\ \text{mm} \geqq 0.44\ \text{mm, and}$$

$$L\ \text{mm} \leqq 75\ \text{mm}.$$

2. A projection type cathode ray tube according to claim 1, wherein an axial length of said first cylinder electrode is in a range of from 15 mm to 25 mm.

3. A projection type cathode ray tube according to claim 2, wherein an inside diameter of said third cylinder electrode is in a range of from 20 mm to 22.5 mm.

4. A projection type cathode ray tube according to claim 3, wherein a distance between said end of said second cylinder electrode on said phosphor screen side thereof and a center of said phosphor screen is in a range of from 120 mm to 150 mm.

5. A projection type cathode ray tube according to claim 4, wherein a thickness of said G1 electrode is in a range of from 0.05 mm to 0.15 mm.

6. A projection type cathode ray tube according to claim 5, wherein said electron-emissive material is comprised chiefly of an oxide of alkaline earth metals including at least Ba, and contains a composite oxide of barium and scandium, and said scandium is in a range of from 0.01 wt % to 5.0 wt % of said electron-emissive material.

7. A projection type cathode ray tube according to claim 6, wherein said oxide of alkaline earth metals is an oxide composed of barium, strontium and calcium, (Ba.Sr. Ca)O, and said composite oxide of barium and scandium is barium scandate $Ba_2Sc_2O_5$.

8. A projection type cathode ray tube according to claim 7, wherein said anode voltage is in a range of from 25,000 V to 35,000 V and said focus voltage is in a range of from 5,000 V to 12,000 V.

9. A projection type cathode ray tube according to claim 8, wherein said anode voltage is in a range of from 25,000 V to 35,000 V and said focus voltage is a fixed voltage in a range of from 5,000 V to 12,000 V which is superimposed with a dynamic focus voltage equal to or lower than 12,000 V and varying in synchronism with deflection of said electron beam.

10. A projection type cathode ray tube according to claim 9, wherein an outside diameter of said neck portion is approximately 29 mm.

11. A projection type cathode ray tube according to claim 10, wherein an overall length of said projection type cathode ray tube is in a range of from 240 mm to 290 mm.

12. A projection type cathode ray tube according to claim 1, wherein an inside diameter of said third cylinder electrode is in a range of from 20 mm to 22.5 mm.

13. A projection type cathode ray tube according to claim 1, wherein a distance between said end of said second cylinder electrode on said phosphor screen side thereof and a center of said phosphor screen is in a range of from 120 mm to 150 mm.

14. A projection type cathode ray tube according to claim 1, wherein said anode voltage is in a range of from 25,000 V to 35,000 V and said focus voltage is in a range of from 5,000 V to 12,000 V.

15. A projection type cathode ray tube according to claim 1, wherein said anode voltage is in a range of from 25,000

V to 35,000 V and said focus voltage is a fixed voltage in a range of from 5,000 V to 12,000 V which is superimposed with a dynamic focus voltage equal to or lower than 12,000 V and varying in synchronism with deflection of said electron beam.

16. A projection type cathode ray tube according to claim 1, wherein a thickness of said G1 electrode is in a range of from 0.05 mm to 0.15 mm.

17. A projection type cathode ray tube according to claim 1, wherein an outside diameter of said neck portion is approximately 29 mm.

18. A projection type cathode ray tube according to claim 1, wherein an overall length of said projection type cathode ray tube is in a range of from 240 mm to 290 mm.

19. A projection type cathode ray tube according to claim 1, wherein said electron-emissive material is comprised chiefly of an oxide of alkaline earth metals including at least Ba, and contains a composite oxide of barium and scandium, and said scandium is in a range of from 0.01 wt % to 5.0 wt % of said electron-emissive material.

20. A projection type cathode ray tube according to claim 19, wherein said oxide of alkaline earth metals is an oxide composed of barium, strontium and calcium, (Ba.Sr. Ca)O, and said composite oxide of barium and scandium is barium scandate $Ba_2Sc_2O_5$.

* * * * *